US006511244B1

(12) United States Patent
Cohen

(10) Patent No.: US 6,511,244 B1
(45) Date of Patent: Jan. 28, 2003

(54) BINDER

(75) Inventor: Jossef Cohen, Rishon Lezion (IL)

(73) Assignee: C.I.Q. International Ltd. (IL)

( * ) Notice: Subject to any disclaimer, the term of this patent is extended or adjusted under 35 U.S.C. 154(b) by 0 days.

(21) Appl. No.: 09/928,641

(22) Filed: Aug. 13, 2001

(51) Int. Cl.[7] ..... B42F 13/20

(52) U.S. Cl. ..... 402/38; 402/26; 402/31; 402/36

(58) Field of Search ..... 402/26, 31, 36, 402/37, 38, 39, 40, 41, 42

(56) References Cited

U.S. PATENT DOCUMENTS

| | | | | |
|---|---|---|---|---|
| 3,809,485 A | * | 5/1974 | Beyer | 402/31 |
| 4,368,995 A | | 1/1983 | Cohen | 402/39 |
| 5,160,209 A | * | 11/1992 | Schuessler | 402/73 |
| 5,924,811 A | * | 7/1999 | To et al. | 402/26 |
| 5,964,544 A | * | 10/1999 | Ko | 402/26 |

FOREIGN PATENT DOCUMENTS

| | | |
|---|---|---|
| EP | 482354 A1 | 9/1991 |
| EP | 482354 B1 | 9/1991 |
| GB | 2277484 | 11/1994 |
| IL | 124302 | 9/1999 |

* cited by examiner

*Primary Examiner*—Willmon Fridie, Jr.
(74) *Attorney, Agent, or Firm*—Morgan & Finnegan LLP

(57) ABSTRACT

The present invention relates to a binder comprising a cover made up of two lateral parts; at least one pair of rails; said rails extending parallel to the sides of the lateral parts and at the inside thereof; and a metal ring mechanism located upon said cover, which mechanism is provided at each side with at least one built in projection (herein: "a removable and/or replaceable metal ring mechanism"); said built in projections to be inserted into corresponding rails. Moreover, the invention relates to a removable and/or replaceable metal ring mechanism, which mechanism is provided at each side with at least one built in projection.

20 Claims, 4 Drawing Sheets

16
9
14
17

13b
14
18

16
10
20
18
13a
18

20
16

BINDER

FIELD OF THE INVENTION

The present invention relates to binders for filing perforated papers, documents, etc., provided with a removable and/or replaceable metal-ring mechanism (as herein defined).

BACKGROUND OF THE INVENTION

There are known various binders for the above purpose, e.g. those described and claimed in UK Specification 2,277,484 (Treilet), EP Specification 482354 and Israeli Specification 124302. However, these binders all use lever-arch mechanism which are not used in metal-ring mechanism binders.

In the U.S.A such lever-arch mechanism are very rarely used. There the binders are provided with a fixed metal-ring mechanism, in which mechanism said rings may be opened. The above known lever-arch mechanism binders are not suitable for these metal-ring mechanisms.

A metal-ring mechanism in connection with the present invention is a metallic plate carrying at least one ring, preferably three, which rings may be opened either manually or by a mechanical arrangement located at a suitable place of the plate. The rings may have any suitable form, e.g. it may be a ring proper, a rectangular ring, a D-like ring or the like. Such mechanisms are known e.g. from U.S. Pat. No. 4,368,995.

OBJECT OF THE INVENTION

Thus, a binder should be designed using such a metal-ring mechanism which may be removable and/or replaceable from the binder. In such a binder the cover may be made of a suitable rigid plastic material, e.g. polypropylene, polyethylene etc or from a cardboard per se or from a cardboard covered with a suitable plastic foil material, e.g. PVC, polypropylene, polyethylene etc. Said binder should be easy to manufacture and to use, to enable the storage of binders that are not in use while the removable and/or replaceable metal ring mechanism together with the perforated papers hold in the binder is removed and stored somewhere else. Said binder while handling large quantities of binders, cover and metal ring mechanism may be packed separately, enabling larger quantities to be displaced from one place to another, occupying much less volume than when mechanism is permanently fixed on the cover as it is now. Moreover, the mechanism should be mounted in such a manner that it cannot slide outwards; and the binder, should be relatively cheap.

SUMMARY OF THE INVENTION

The present invention thus consists in a binder comprising a cover made up of two lateral parts; at least one pair of rails; said rails extending parallel to the sides of the lateral parts and at the inside thereof; and a metal ring mechanism located upon said cover, which mechanism is provided at each side with at least one built in projection (hereinafter: "a removable and/or replaceable metal ring mechanism"); said built in projections to be inserted into corresponding rails.

Advantageously a central part is located between the two lateral parts of the cover. Preferably each pair of built in projections corresponds to a corresponding separate pair of rails extending on a corresponding part of the cover.

In a further embodiment of the binder according to the present invention the removable and/or replaceable metal-ring mechanism comprises a further plate which is connected by suitable means, e.g. screws, bolts, nails and rivets, etc to its lower side. In this case the built in projection(s) extend from said further plate. In said embodiment the removable and/or replaceable metal-ring mechanism may consist in the known metal-ring mechanism and a further plate from which extends at least one built in projection in each side; in which said plate is connected by suitable means, e.g. screws, bolts, nails and rivets, etc to the lower side of said known mechanism.

The rails may extend along one lateral side of the binder or on the central part if present. They may extend along the entire length of said part or along a part thereof. It is essential that two rails extend one opposite the other on the opposite sides of the removable and/or replaceable metal-ring mechanism. Preferably each pair of rails correspond to a pair of built in projections. Preferably there are present three pairs of rails which correspond to the three pairs of built in projections. All said possibilities are within the scope of the present invention.

In a further embodiment of the present invention, abutments are located on the cover vertically to the rails substantially at the ends of the removable and/or replaceable metal-ring mechanism. Said abutments prevent the removable and/or replaceable metal-ring mechanism from sliding outwards. In a preferred embodiment of the present invention two abutments are present in which one abutment, preferably, the lower abutment, is higher and longer than the other abutment, preferably the upper abutment. The high and long abutment serves for preventing any possibility to remove the mechanism at said side whereas the other abutment allows the insertion and the removal of the mechanism.

There may also be present further abutments on the cover, which abutments engage the removable and/or replaceable metal-ring mechanism in a hole, if present, for riveting the removable and/or replaceable metal-ring mechanism to the cover.

The removable and/or replaceable metal-ring mechanism and the further plate, if present, are advantageously, made of a metal, e.g. steel, aluminum, etc.

Should the cover made of cardboard and/or cardboard covered with plastic foil material, the rails cannot be inserted therein. In this case a metal board has to be fixed on the cover; and the rails as described hereinbefore have to extend along said metal board. The fixation of the metal board on the cover may be performed by any suitable means, e.g. screws, bolts, nails and rivets, etc. This possibility is also within the scope of the present invention.

In all embodiments the built in projections of the removable and/or replaceable metal-ring mechanism have to be inserted into the corresponding rails. When the removable and/or replaceable metal-ring mechanism is to be removed said built in projections are disconnected from the rails.

The binder according to the present invention may be sold as one unit. However, the various parts of the binder i.e. the cover and the a removable and/or replaceable metal ring mechanism may be manufactured separately and assembled at a suitable place thus forming the binder. Said possibilities are also within the scope of the present invention.

The present invention further consists in a removable and/or replaceable metal ring mechanism which consists in a metal ring mechanism, which mechanism is provided at each side with at least one built in projection.

In a further embodiment of the removable and/or replaceable metal-ring mechanism, said mechanism comprises a further plate which is connected by suitable means, e.g. screws, bolts, nails and rivets, etc to its lower side. In this case the built in projection(s) extend from said further plate. In said embodiment the removable and/or replaceable metal-ring mechanism may consists in the known metal-ring mechanism and a further plate from which extends at least one built in projection in each side; in which said plate is connected by suitable means, e.g. screws, bolts, nails and rivets, etc to the lower side of said known mechanism.

Said removable or replaceable metal ring mechanism may be used for various purposes, e.g. drawers in filing cabinets, portable filing bags or boxes.

DESCRIPTION OF DRAWINGS

The present invention will now be illustrated with reference to the accompanying drawings without be limited to them. Identical parts appearing in several Figs. are marked for the sake of clarity by the same numerals.)

In said drawings.

DETAILED DESCRIPTION OF THE DRAWINGS

Figure 1B:
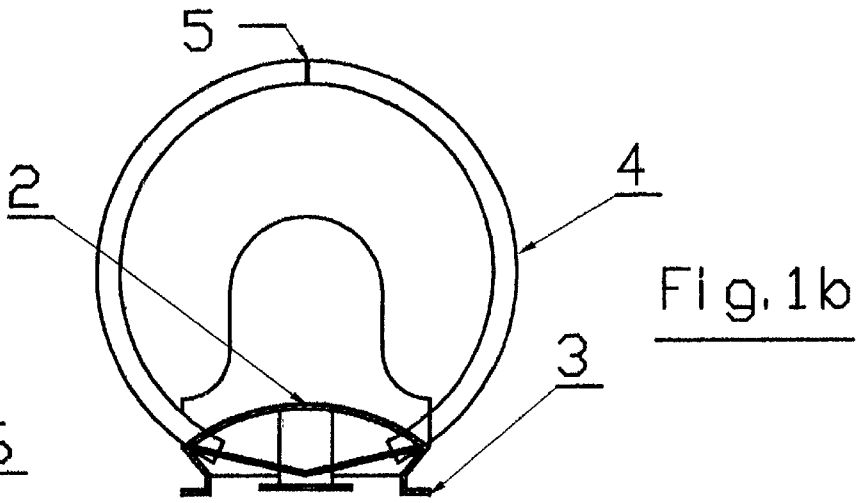
FIG. 1*b* shows cross section of a ring of a removable and/or replaceable metal-ring mechanism of FIG. 1*a;*

In said Figs. removable and/or replaceable metal-ring mechanism 1 comprises plate 2 along which extend built in projections 3 (FIGS. 1*a* and 1B) and upon which are located rings 4. Said rings 4 may be opened at points 5 either by hand or mechanically. At both ends of plate 2 are located means 6 for opening rings 4.

Figure 2:
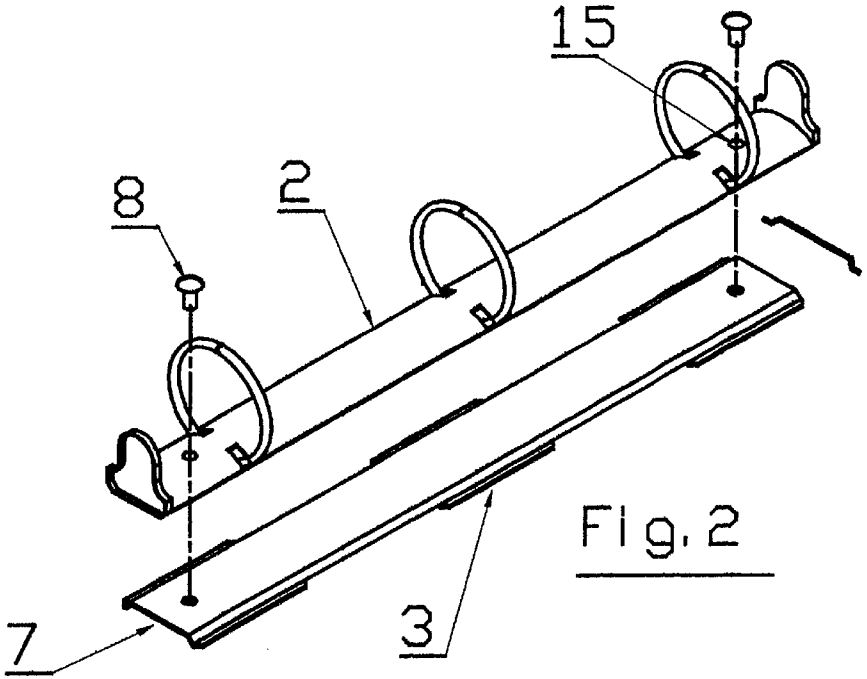
FIG. 2 shows a perspective view of another embodiment of a removable and/or replaceable metal-ring mechanism which comprises a further plate with built in projections.

In FIG. 2 further plate 7 extends below plate 2. Plates 2 and 7 are connected to each other by means 8. Built in projections 3 extend along plate 7.

Figure 3:
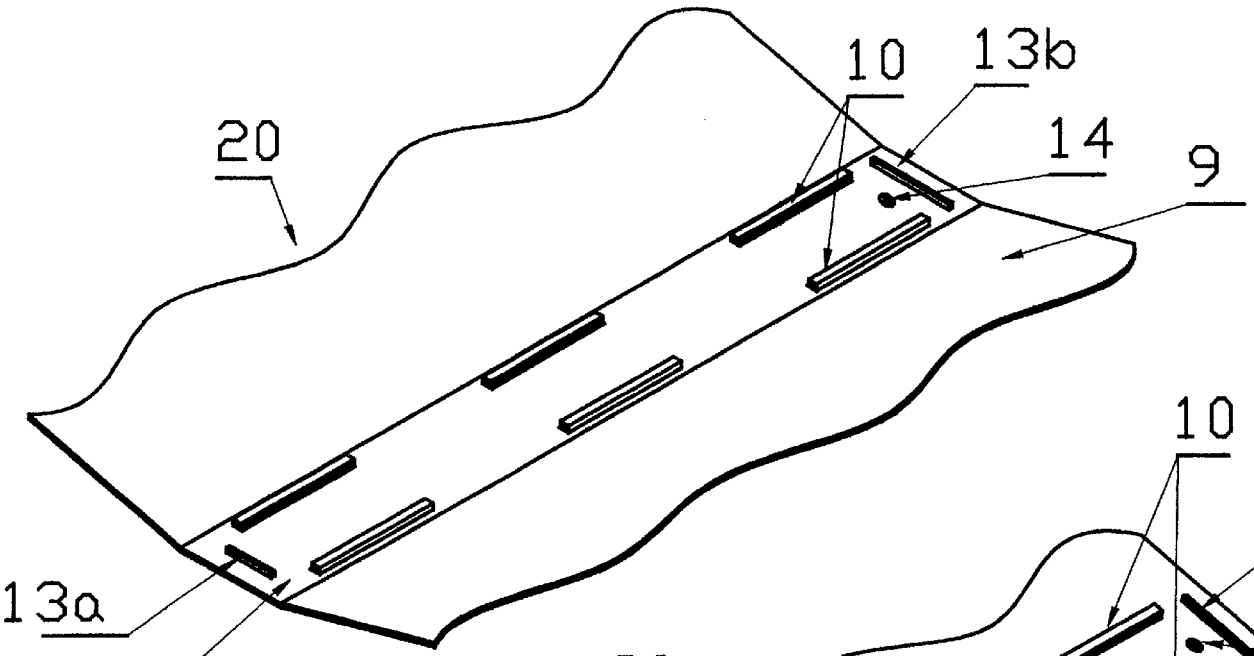
FIG. 3 shows a top view of an open binder wherein the rails extend on the central part of the cover.
Figure 5:
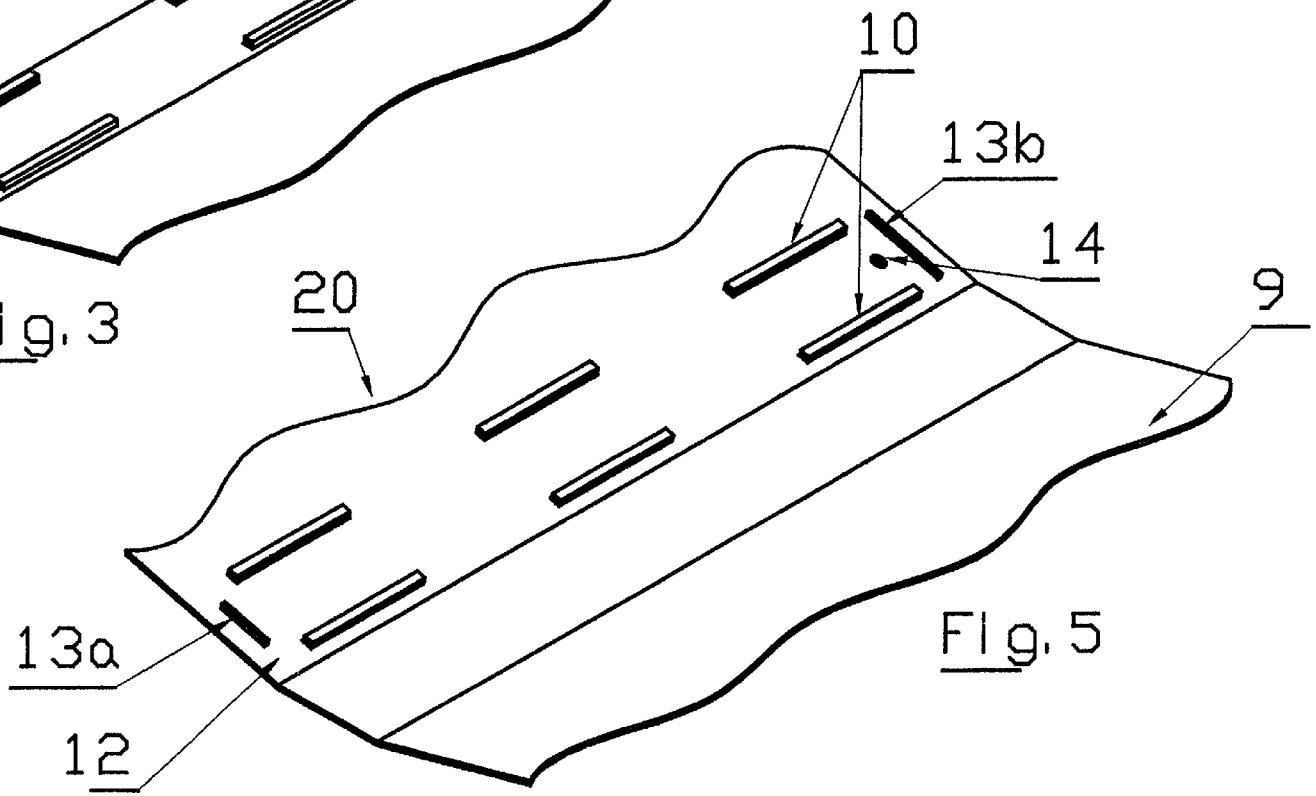
FIG. 5 shows a top view of an open binder wherein the rails extend on one lateral part of the cover.

FIGS. 3 and 5 show cover 9 upon which extend three pairs of rails 10 at central part 11 (FIG. 3) and lateral part 12 (FIG. 5) There are present on cover 9 abutments 13*a* and 13*b* at both ends corresponding to both ends of plate 2 (not shown) and abutment 14 to engage removable and/or replaceable metal-ring mechanism 1 in hole 15 (shown only in FIGS. 1,2,4 and 6) for riveting same into cover 9.

Figure 4:
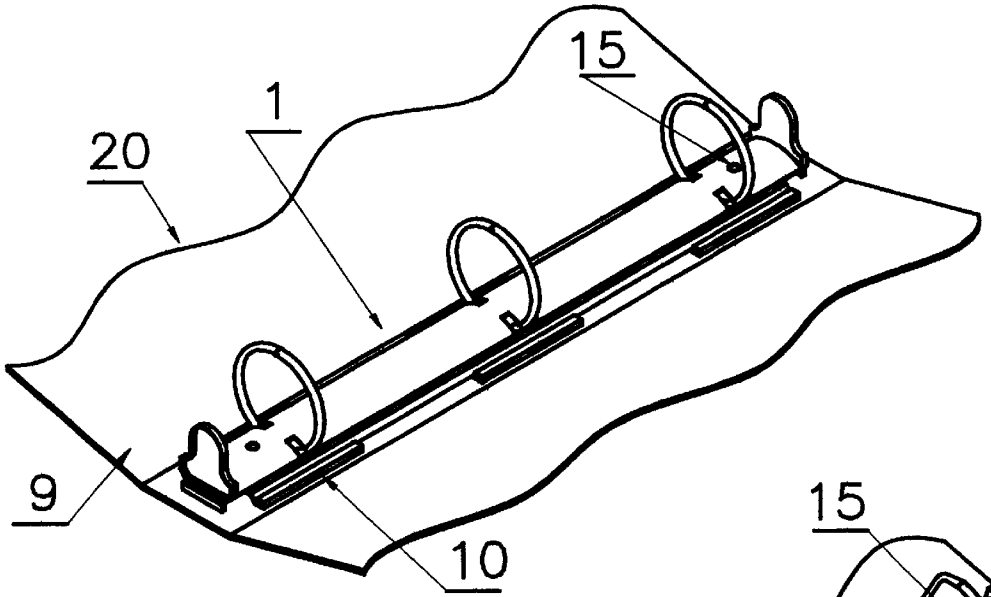
FIG. 4 shows a binder as shown in FIG. 3 with a removable and/or replaceable metal-ring mechanism mounted upon it.
Figure 6:
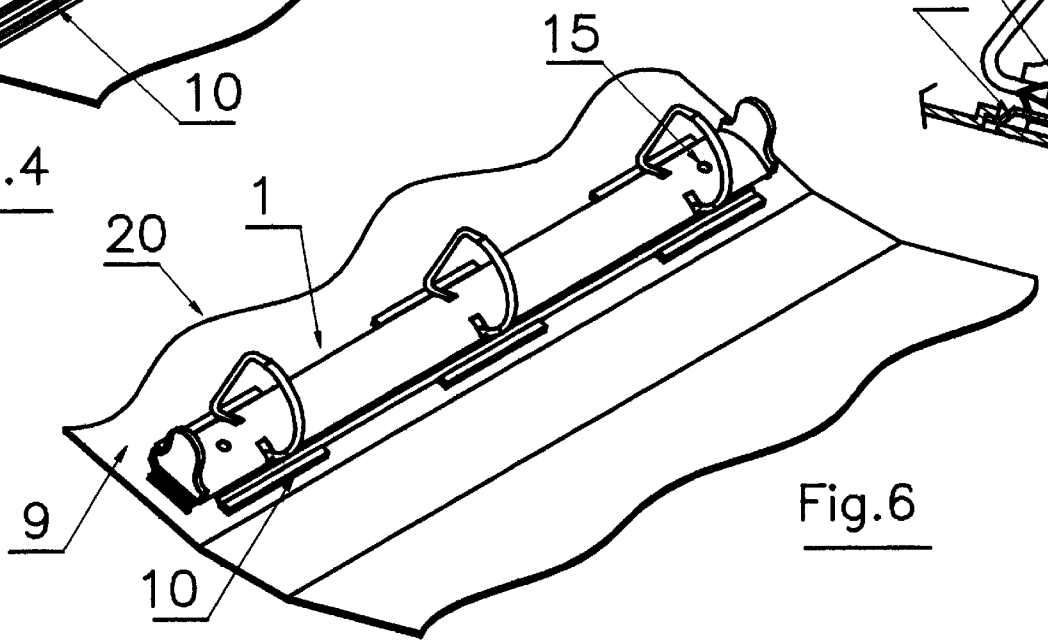
FIG. 6 shows a binder as shown in FIG. 5 with a removable and/or replaceable metal-ring mechanism mounted upon it.

FIGS. 4 and 6 show respectively FIGS. 3 and 5 in which removable and/or replaceable metal-ring mechanism 1 is mounted on cover 9. Built in projections 3 (not shown) are inserted at suitable places into rails 10.

Figures 7, 8, 9:
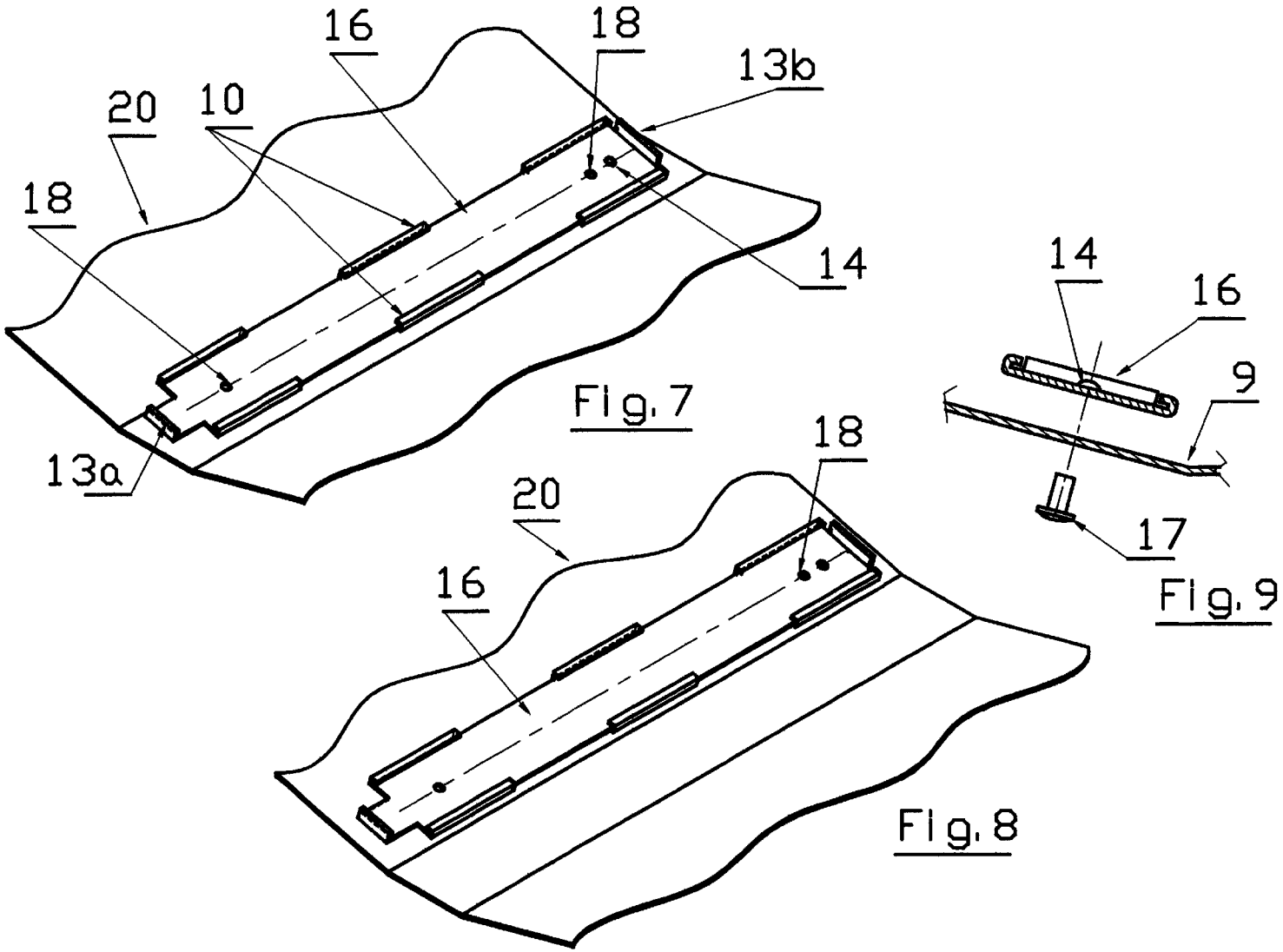
FIG. 7 shows a top view of an open binder with a metallic board fixed to the central part of the cover.
FIG. 8 shows a top view of an open binder with a metallic board fixed to one lateral part of the cover.
FIG. 9 shows a cross section of a cover shown in FIG. 8.

FIGS. 7 and 8 show cover 9 (made of card board) as shown in FIGS. 3 and 5 on which is fixed metal board 16. Said metal board 16 is fixed to cover 9 by way of rivet 17 (FIG. 9). Also shown are rails 10, abutments 13*a* and 13*b,* 14 and holes 18 for rivets 17.

Figure 10A:
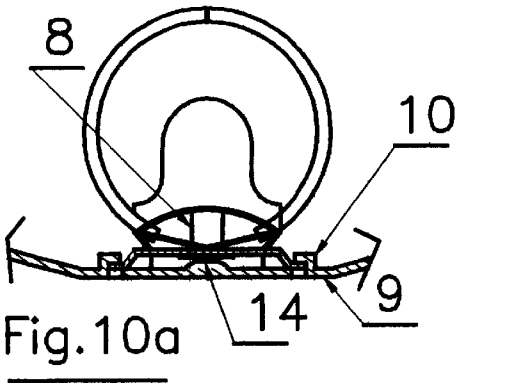
FIGS. 10*a* and 10*b* shows various shapes of the metal ring.
Figure 10B:
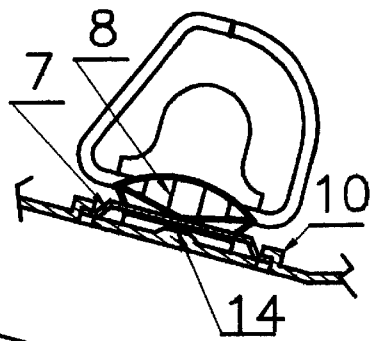

FIGS. 10*a* and 10*b* show various forms of metal rings 4. In FIG. 10*a* ring 4 is circular and in FIG. 10*b* it has substantially a D-form. Moreover, in said Figs. removable and/or replaceable metal-ring mechanism 1 comprises further plate 7, also are shown inter alia plate 7, means 8 and rails 10.

Figure 1A:
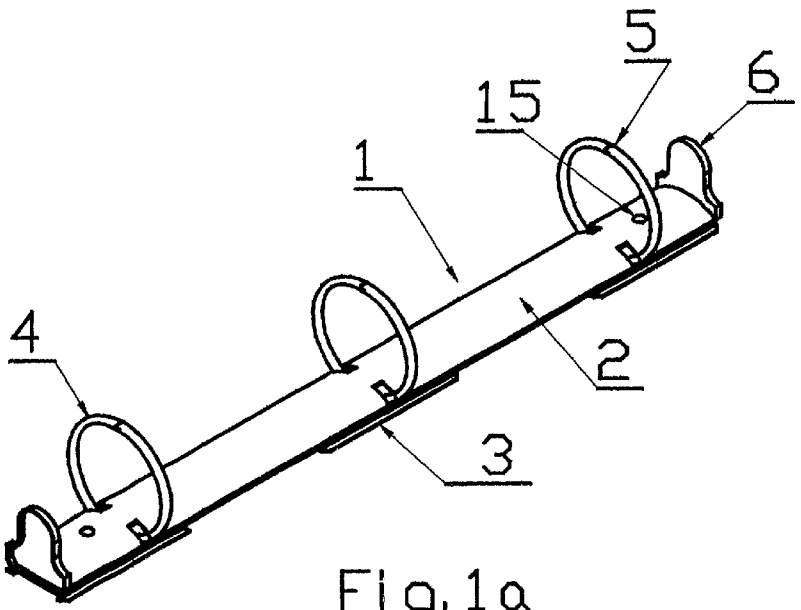
FIG. 1*a* shows a perspective view of a removable and/or replaceable metal-ring mechanism with built in projections.

In FIGS. 1*a,* 2, 3, 4, 5, 6, 7, and 8 the binder is shown schematically and marked 20.

In FIGS. 1*a,* 1*b,* 2, 4 and 10*a* ring 4 is circular whereas in FIGS. 6 and 10*b* ring 4 has substantially a D-form.

What is claimed is:

1. A binder comprising a cover made up of two lateral parts; at least one pair of elongate rails; said elongate rails being integrally formed with said cover and extending parallel to the sides of the lateral parts and at the inside thereof; and a replaceable ring mechanism located upon said cover, which mechanism is provided at each side with at least one built in projection; said built in projection(s) to be inserted into a corresponding elongate rail.

2. A binder according to claim 1, wherein the replaceable ring mechanism carries three rings.

3. A binder according to claim 1, wherein a central part is located between the two lateral parts of the binder.

4. A binder according to claim 1, wherein the replaceable ring mechanism further comprises a plate which is connected to the lower side of said mechanism; and the built in projection(s) extend from said plate.

5. A binder according to claim 4, wherein the built-in projection(s) extend(s) from a side of said plate.

6. A binder according to claim 1, wherein the rails extend on one lateral part of the binder.

7. A binder according to claim 1, wherein the rails extend on the central part of the binder.

8. A binder according to claim 1, wherein a pair of two rails extend one opposite the other on the opposite sides of the replaceable ring mechanism.

9. A binder according to claim 1, wherein a pair of elongate rails corresponds to a pair of built in projections.

10. A binder according to claim 1, wherein abutments are placed on the cover perpendicularly with respect to the elongate rails substantially at the ends of the replaceable ring mechanism, said abutments being integrally formed with the cover.

11. A binder according to claim 1, wherein further abutments are located on the cover, wherein said abutments engage the replaceable ring mechanism, said abutments being integrally formed with the cover.

12. A binder according to claim 1, wherein the cover is made of a rigid plastic material.

13. A binder according to claim 1, wherein the cover is made of cardboard.

14. A binder according to claim 13 in which a metal board is fixed on the cover, on which board the rails extend and the replaceable ring mechanism is mounted on said metal board.

15. A binder according to claim 1, wherein the various parts of the binder may be manufactured separately and assembled at a suitable place thus forming the binder.

16. A binder according to claim 1 wherein the cover and integrally formed rails and abutments of said binder are formed entirely of a plastic material.

17. A binder according to claim 1 wherein the ring mechanism is formed entirely of a plastic material.

18. A binder according to claim 1 wherein the ring mechanism is formed entirely of metal.

19. A binder according to claim 1, wherein the cover is made of cardboard covered with plastic foil.

20. A binder according to claim 19 in which a metal board is fixed on the cover, on which board the rails extend and the replaceable metal-ring mechanism is mounted on said metal board.

* * * * *